United States Patent [19]

Rogers

[11] Patent Number: 4,662,144

[45] Date of Patent: May 5, 1987

[54] RESTORATION OF DETERIORATED PLASTER SURFACES

[76] Inventor: Rodrick M. Rogers, 4201 Somerdale La., Charlotte, N.C. 28205

[21] Appl. No.: 740,884

[22] Filed: Jun. 3, 1985

[51] Int. Cl.[4] ..... E04B 1/00

[52] U.S. Cl. ..... 52/744; 52/514; 264/36

[58] Field of Search ..... 52/514, 743, 744; 156/71; 264/36; 428/63

[56] References Cited

U.S. PATENT DOCUMENTS 2,162,658 6/1939 Wieslander ..... 52/514 X
3,576,091 4/1971 Shull, Jr. et al. ..... 156/71 X
3,984,269 10/1976 Schneller et al. ..... 156/71

OTHER PUBLICATIONS

*The Condensed Chemical Dictionary,* 8th edition Gessner G. Hawley, 1971, p. 28.

*Primary Examiner*—Carl D. Friedman
*Attorney, Agent, or Firm*—Clifton Ted Hunt

[57] ABSTRACT

A method for restoring a large area of deteriorated plaster wherein several layers of joint compound are applied to the cleaned out work area. A screen is applied with the first layer and the second layer and the second layer has a sufficient layer removed while wet to be made flush with the original plaster surface.

10 Claims, 6 Drawing Figures

RESTORATION OF DETERIORATED PLASTER SURFACES

BACKGROUND OF THE INVENTION

Many times the plasterer is called upon to repair badly cracked ceilings and walls. Heretofore, this has been a time consuming and unreliable operation. Many times, after the restoration has been completed, cracks will develop again even though the workmanship has been good in the plaster restoration. The fault often lies with the building structure rather than with the skill of the plasterer.

The prior art has dealt with the problem of recurring cracks by completely replastering the area of the cracked plaster. For the type of crack that is only slightly visible, an area of the plaster about thirty (30) inches wide and extending beyond the length of the crack is removed down to the laths. The area is then replastered by browning and finishing as in new work. Large wide cracks such as those that recur during the dry heated season of the year have heretofore been dealt with by completely relathing and replastering the entire ceiling or wall by nailing furring strips at right angles to the joists over the old laths and plaster. New laths are applied to the furring strips and the area is then plastered as if it were new work. The purpose of the new furring strips and laths is to spread the movement of a joist over a larger area with the expectation that any excessive deflection will be relieved at a wall angle where it may be hidden by a molding or may not be objectionable if visible. The time and expense of furring and relathing is eliminated by the present invention.

The closest prior art known to applicant is the GLID-WALL FIBERGLASS WALL SYSTEM marketed by Glidden Coatings and Resins, a division of SCM Corporation, Cleveland, Ohio 44115. Published literature on the GLID-WALL SYSTEM explains that it is applied over existing plaster which is badly cracked by first scraping the peeled paint and plaster from the wall and then filling the cracks and voids with a latex patching compound. Next, a vapor barrier primer-sealer is applied to a forty-eight (48) inch wide wall section from ceiling to baseboard and correspondingly sized strips of fiberglass are pressed against the wet sealer coat using a dry roller or wallpaper smoothing tool to smooth the fiberglass onto the wall while removing all air bubbles to create a tight bond. The adhesive vapor barrier primer-sealer coat is then applied to the next forty-eight (48) inches of wall area and a second forty-eight (48) inch wide strip of fiberglass is pressed onto the wall, overlapping the first strip of fiberglass by several inches. The overlapping edges are cut away and the remaining cut edges are meshed into one piece. The two strips of completed fiberglass panels are then saturated with a coat of the vapor barrier primer-sealer to seal the pores in the material and create a smooth primed surface ready to accept a finish coat of paint.

One difficulty with the GLID-WALL SYSTEM is that the resulting surface is a textured surface, lacking the conventional and accepted smoothness of plaster, because the fiberglass has a minimum thickness of twenty-two (22) mils and its texture cannot be covered by two coats of paint.

The Tuff-Kote Company, Inc. of Woodstock, Ill. markets a fiberglass screen-like mesh having a thickness of four (4) mils and various sizes up to twelve (12) square feet for use with a special joint compound or mastic it markets under the trademarks KRACK-KOTE, TUFF-KOTE and TUFFGLASS. The label on the KRACK-KOTE mastic informs the user to "Always Use With TUFFGLASS Fabric", and explains that the result of proper application is to bridge wall and ceiling cracks instead of filling them. The TUFF-KOTE products are intended for use in the repair of cracks in plaster, masonry and wood. KRACK-KOTE mastic and TUFFGLASS fabric are used in repairing wall and ceiling cracks. The fabric is four (4) mils thick, three and three-fourths ($3\frac{3}{4}$) inches wide and thirty-six (36) feet long. The printed directions call for the edges of the crack to be smoothed and cleaned and a sealer to be applied to the crack before applying the special KRACK-KOTE mastic. The KRACK-KOTE mastic is applied liberally, covering the crack and about two and one-half ($2\frac{1}{2}$) inches on each side of the crack. A strip of the TUFFGLASS fabric is embedded in the mastic and excess mastic is removed by wiping out the wrinkles and excess material with an applicator so that the fabric is tight against the wall surface and the meshes filled with mastic. The first coat of mastic is allowed to dry and a second coat is brushed on lightly and the edges are feathered to make a smooth uniform surface with the wall or ceiling. Prime and finish coats of paint are then applied to complete the job.

There is no suggestion in the TUFF-KOTE literature of using the KRACK-KOTE system for the repair of map cracking or restoring a complete wall. The twelve (12) square foot piece of TUFFGLASS fabric is sold with TUFF-KOTE mastic labelled "For External Use" and described as being useful for patching roofs, weatherproofing wood, repairing gutters, and waterproofing masonry. Again, there is no suggestion of using it for repairing map cracking or restoring a complete wall. TUFF-KOTE, KRACK-KOTE, and TUFFGLASS are trademarks of Tuff-Kote Company, Inc., Woodstock, Ill.

SUMMARY OF THE INVENTION

According to the present invention, a large expanse of badly deteriorated plaster, such as a complete plaster wall or ceiling, can be quickly, inexpensively and reliably restored to its original smooth condition without the inconvenience and expense of tearing out all of the old plaster and installing new lath and plaster. According to the invention, the surface of the restored plaster will be smoother than obtained by the GLID-WALL system and the restoration will be more durable than any of the known prior art restorations.

Briefly, applicant's system includes the steps of cleaning away the peeled plaster and paint, patching large cracks with plaster of paris, applying a liquid alkyd sealer to the area to be resurfaced, allowing the sealer to dry, applying a first thin coat of conventional joint compound over a workable portion of the area to be resurfaced and while that is wet applying a synthetic screen to the wall by pressing the screen into the joint compound and troweling away the excess joint compound, allowing the first coat of joint compound to dry, applying a second thin coat of joint compound which fills the interstices of the screen and the space occasioned by normal shrinkage of the first coat of joint compound to provide a smooth finished plaster surface.

The alkyd sealer serves as a moisture barrier and as a bonding agent to unite particles of the original chalky plaster and present a stabilized surface to receive and retain the joint compound used in the plaster restoration.

The screen used in applicant's invention is preferably about twelve (12) mils thick and has great tensile strength. The screen is pressed firmly against the patched wall surface and care is taken to see that the screen contacts the wall at all points except where there is a deep, narrow crack which is filled with joint compound and bridged by the screen.

The application of the second coat of joint compound after the first coat has dried provides smoothness to the finished wall surface because the second coat fills the space occasioned by shrinkage of the dried first coat and fills the interstices between the fibers of the screen, terminating in the same plane as the outermost fibers of the screen to provide a smooth finished surface.

It is an object of the invention to provide a method of repairing large areas of deteriorated plaster wherein steps are taken to strengthen the structure simultaneously with the restoration of the plaster, which steps also contribute to the restoration of the original smoothness of the surface on the restored plaster.

It is another object of the invention to provide a method of restoring large areas of deteriorated plaster which includes the step of providing a screen formed of woven synthetic fibers having a thickness about three (3) times that of the prior art screen used in the repair of individual cracks and possessing about three (3) times the strength of said prior art screen and thereby contributing to the strength of the structure and the longevity of the restored plaster.

A further object of the invention is to provide a method of the type described wherein said screen has a uniform mesh which is filled with joint compound to provide a common plane occupied by the joint compound and the outermost portion of the screen and thereby restoring the original smoothness to the restored plaster.

A still further object of the invention is to provide a method of the type described wherein a moisture barrier is initially applied to the cleaned original plaster to protect the joint compound from contamination by moisture emanating from the supporting structure and thereby prolonging the life of the restored plaster.

Another object of the invention is to provide a method of the type last described wherein the moisture barrier is an alkyd sealer which also serves as a bonding agent to unite and stabilize particles of the original plaster to receive and retain the joint compound used in the plaster restoration.

DETAILED DESCRIPTION OF THE INVENTION

Figure 1:
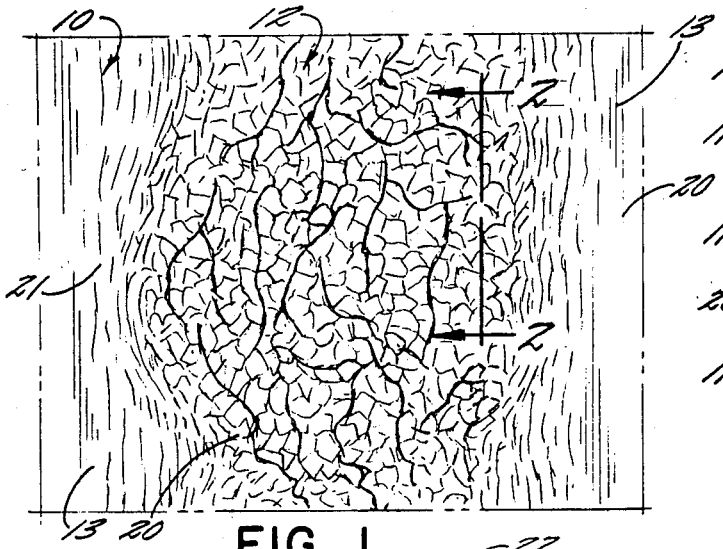
FIG. 1 is a fragmentary plan view of a work area in a large plaster surface which may be the major portion or all of a wall or ceiling which has map cracking and deeper cracks and which is representative of the type of plaster surface with which the present method is intended to be used.

Referring more specifically to the drawings, a portion of a deteriorated plaster ceiling or wall 10 is illustrated in FIG. 1 with map cracking 11 and larger cracks 11A, 11B and 11C. The portion of the deteriorated work shown in FIG. 1 is referred to herein as the "work area" and is broadly indicated at 12 to distinguish the deteriorated plaster from the adjoining good plaster 13 that need not be restored.

It is believed helpful to an understanding of the invention to explain how the original plaster was formed and to then explain some of the conditions which commonly contribute to deterioration of the plaster. The first step in plastering an area is to provide a base for the plaster. Such a base is commonly called lath and may be formed of strips of wood or perforated metal or panels of gypsum, either smooth or perforated. This is not an exhaustive list of lath materials but is considered sufficiently representative of lath materials for an understanding of the invention.

Figure 2:
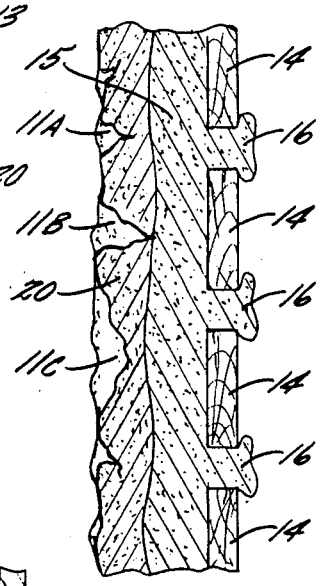
FIG. 2 is an enlarged sectional view of the work area taken substantially along the line 2—2 in FIG. 1.
Figure 6:
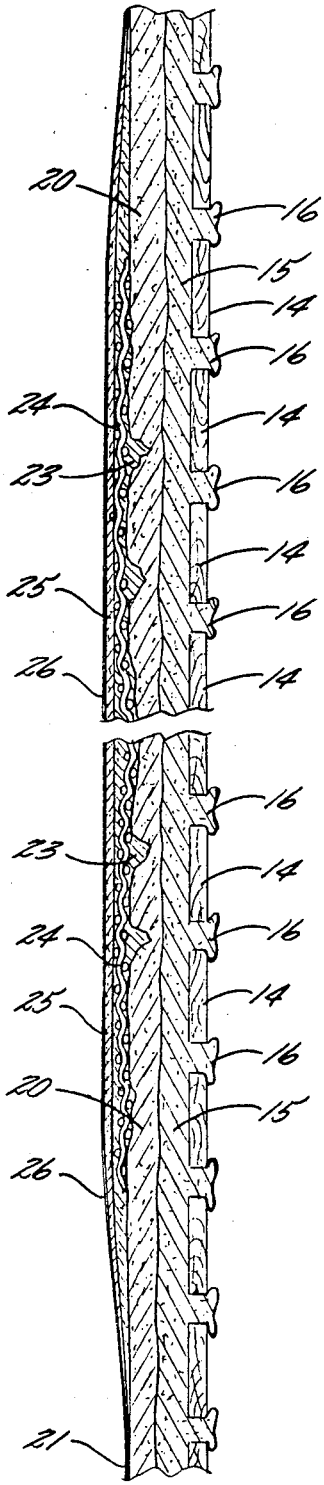
FIG. 6 is a sectional view, with parts broken away, of the entire work area after it has been completely restored, illustrating how it is feathered into adjoining areas.

The invention is equally useful with all types of lath but for purposes of illustration, the plaster wall 10 is illustrated as having been applied to wooden lath 14. Plaster is sometimes applied in two coats and sometimes applied in three coats, depending upon the type of lath and the building codes. It is common to apply two-coat work to wood lath and a two-coat plastering job is illustrated and described in connection with the invention, although the invention is equally useful with three-coat work. FIG. 2 illustrates the original plaster which has deteriorated and which comprises a base or brown coat 15 applied directly to the lath 14 and extending through the keys or spaces between the lath strips 14 as at 16. The finish or putty coat of plaster 20 is applied directly to the brown coat in two-coat work. When originally applied, the finish or putty coat 20 has a desirably smooth surface as illustrated at 21 on the areas 13 adjoining the work area 12 in FIG. 1 and in the lower portion of FIG. 6.

Moisture and movement of the building structure inevitably cause plaster to crack over a period of time, often resulting in the map cracking illustrated in FIG. 1. The two ways known to the prior art of restoring map cracked plaster are both ineffective. The tearing out of all of the map cracked plaster and applying furring strips and new lath and new plaster is far too labor intensive in today's high cost labor market, even though the end result is generally satisfactory because the furring strips strengthen the structure and contribute to the durability of the new plaster, which should have a desirably smooth surface. The prior art GLID-WALL SYSTEM is ineffective in situations where a smooth surface is desired because the GLID-WALL SYSTEM inherently produces a textured surface because of the texture of the fiberglass. The TUFF-KOTE system, using narrow strips of thin or lightweight screen (four mils) and a type of joint compound to bridge and cover individual cracks, is not serviceable for the restoration of a large area of deteriorated plaster with map cracking.

The strengthening of the restored plaster while providing a desirably smooth surface on the restored plaster is accomplished by the present invention without the difficulties experienced in the prior art. According to the invention, a deteriorated or map cracked plaster area such as indicated at 12 in FIG. 1 is repaired by scraping away the loose paint and plaster and dirt until a surface of solid plaster is established. It is not necessary to tear out all of the cracked plaster for the purpose of applying new furring strips as in the prior art. It is only necessary, according to the invention, to strip away the loose plaster and paint down to the point where the scraper encounters resistance. At that point a surface of solid plaster P is established.

For purposes of this invention, an alkyd sealer 22 (FIG. 3) is applied to the entire work area to initially serve as a binder by joining together and stabilizing particles of the original plaster and thereby provide a firm foundation for the joint compound used to restore the original plaster. The alkyd sealer 22 subsequently serves as a moisture barrier which effectively isolates and protects plaster from the moisture in the joint compound used to restore the original plaster and the alkyd sealer protects the plaster from any moisture which may be in the original structure. The sealer is allowed to completely dry, the drying normally taking about twenty-four (24) hours. Any large cracks and holes may be repaired with plaster of paris. The use of plaster of paris is not illustrated in the drawings and is not considered essential to a successful practice of the invention, although it is desirable in some instances.

A first coat of conventional joint compound 23 (ASTM C-475) is applied to the surface of solid plaster P over the dried alkyd resin (and plaster of paris, if used) in sufficient quantity to cover the work area 12 of a selected width between twenty-four (24) and forty-eight (48) inches of the deteriorated map cracked plaster. Screen 24 of a convenient length and of a width corresponding to the width of the applied joint compound is pressed firmly against the surface of solid plaster P through the joint compound 23 while the joint compound is wet. The joint compound 23 should be applied in a sufficient thickness to extend through and beyond the interstices in the screen as the screen is pressed through the joint compound and against the surface of solid plaster P by using a trowel to smooth the screen firmly against the surface of solid plaster P while rexoving excess joint compound that extends through the interstices in the screen as it is pressed against the surface of solid plaster P. The screen is generally visible after the first coat of joint compound 23 dries because the dried compound has shrunk inwardly toward the original plaster P and beyond the plane of the screen. Additional work areas 12 covered with a first coat of joint compound 23 and additional lengths of screen 24 are applied in the manner just described with the proximal edges of adjoining lengths of screen overlapping each other and being smoothed into the joint compound and pressed against the solid plaster surface P, as described.

The screen 24 is preferably of the type commonly used for screen doors and is preferably formed from a synthetic material such as nylon having a thickness of about twelve (12) mils with about fifteen (15) to twenty (20) warp and filling yarns per square inch. The screen is extremely strong, having a shear strength of more than three hundred (300) pounds per square inch laterally. Applied in accordance with the invention, the screen is integrated into and effectively strengthens the restored plaster throughout the work area(s) 12 which may comprise an entire wall or ceiling, thereby contributing to the longevity of the restoration.

Figure 3:
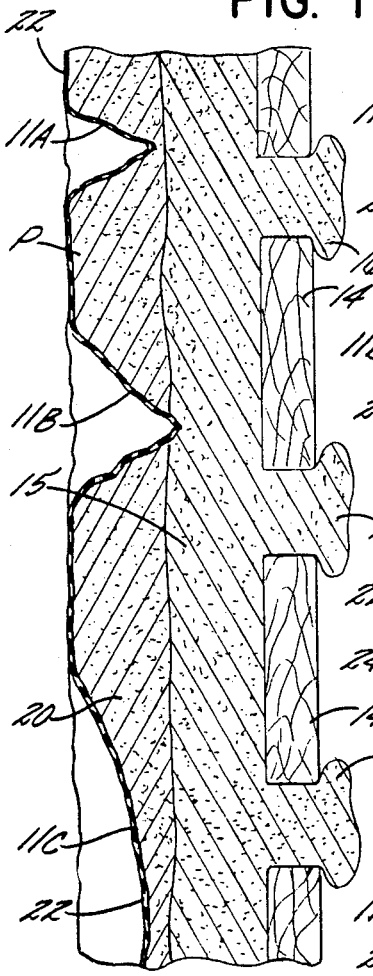
FIGS. 3, 4 and 5 are sequential sectional views illustrating steps in the restoration of the plaster work area shown in FIG. 1.
Figure 4:
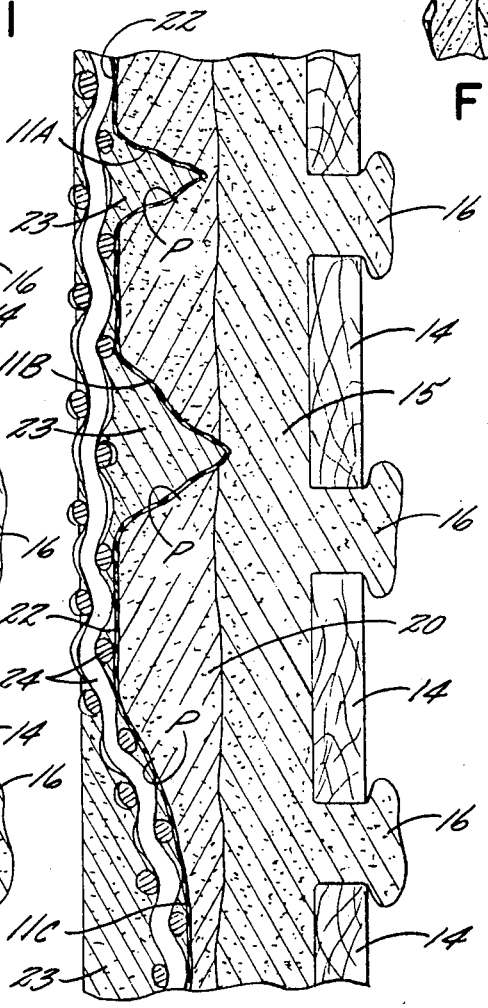
Figure 5:
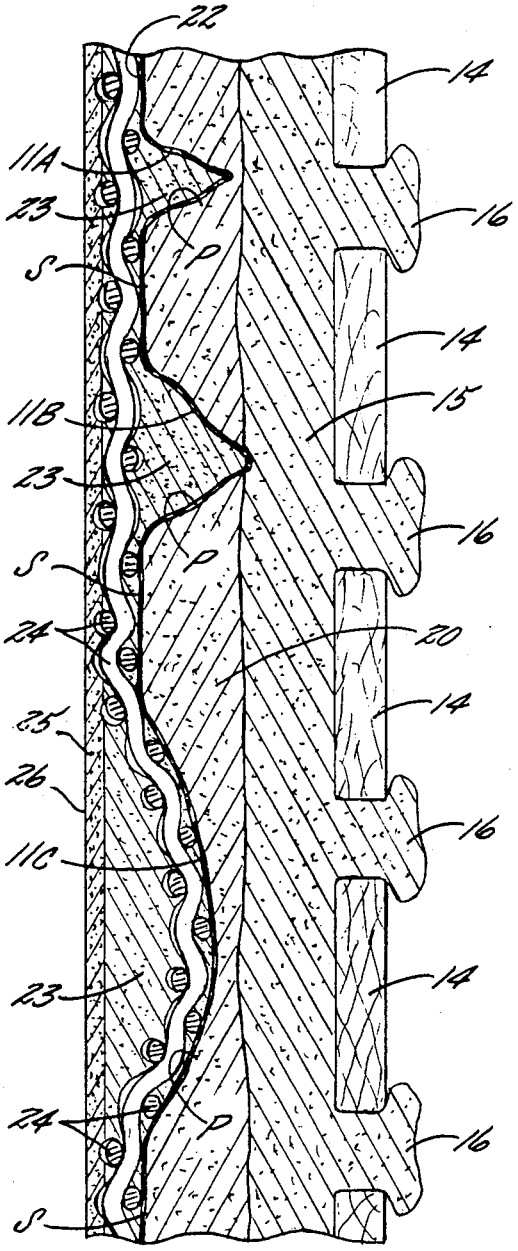

The base coat of joint compound 23 fills the map cracks 11 in the work area 12 and also fills relatively larger cracks and depressions such as indicated at llA, 11B and 11C in FIGS. 3, 4 and 5. Cracks 11A and 11B are relatively narrow and deep cracks which are bridged by the screen 24. The area indicated at 11C is a relatively wide and shallow depression and in such an instance the screen 24 follows the contour of the depression and is pressed against the old solid plaster surface P as seen in FIG. 4. The joint compound 23 extends inwardly to fill the depression 11C with the screen 24 pressed and retained against the surface P.

The flat surface S between the cracks 11A, 11B and between crack 11B and depression 11C in FIG. 4 represents the outermost surface to which the screen 24 is fixed by the joint compound, and FIG. 4 illustrates that a dried coat of joint compound 23 between cracks 11A, 11B and between crack 11B and depression 11C is not as thick as the twelve (12) mils screen 24 because the joint compound shrinks as it dries. Consequently, the screen 24 extends outwardly beyond the dried first coat of joint compound 23, except in the large depressions or recessed areas such as indicated at 11C where the screen is pressed against the solid plaster P below the surface S. The screen 24 does not follow the solid plaster surface P in the relatively narrow cracks 11A and 11B. Instead, the screen bridges the narrow cracks and the first coat of joint compound 23 fills those cracks and extends into the screen with the screen extending beyond the dried compound as illustrated in FIG. 4.

The joint compound 23 is allowed to completely dry, generally for twenty-four (24) hours. A second coat of joint compound 25 is applied over the screen 24 and the dried first coat of joint compound 23. The second coat of joint compound fills the interstices in the screen and is worked with a trowel until the surface 26 of the second coat occupies substantially the same plane as the screen. Consequently, the combined thickness of the first and second coats of joint compound as measured outwardly from the surface S is substantially equal to the thickness of the screen. The screen is thus integrated into the joint compound, and the restored plaster is thereby reinforced and resistant to cracking from normal expansion and contraction of the building structure.

The second coat 25 dries to the smooth surface 26 for the reception of a desired decorative finish, either paint or wall covering (not shown).

There is thus provided an improved method for restoring the original smoothness and appearance to deteriorated map cracked plaster while greatly reinforcing the restored plaster and protecting the restored plaster against moisture in the building structure, thereby providing an economical and durable restoration.

Although specific terms have been employed in describing the invention, they are used in a generic and descriptive sense only and are not limitations on the scope of the invention.

I claim:

1. A method of restoring original smoothness and appearance to a large area of deteriorated map cracked plaster which comprises the steps of:

(a) cleaning the deteriorated plaster by removing peeled plaster and paint and dirt to establish a first work area on a surface of solid plaster, (b) applying a first thin coat of joint compound to fill the cracks in the work area, (c) pressing a screen against the first work area while the joint compound is wet and arranging the screen to bridge narrow cracks in the surface of solid plaster, (d) integrating the screen into the first thin coat of joint compound throughout the work area by
(1) removing sufficient of the first coat of joint compound while wet until the average thickness of the joint compound as measured outwardly from the outermost surface of solid plaster is no greater than the thickness of the screen,
(2) drying and shrinking the joint compound to a lesser thickness than the screen as measured outwardly from the outermost surface of solid plaster,
(3) applying a second thin coat of joint compound to the said dried first coat and to the screen in a sufficient thickness to cover the screen, and
(4) removing sufficient of the second coat of joint compound while it is wet until the combined thickness of the first and second coats equals the thickness of the screen.

2. A method according to claim 1 wherein step (a) is repeated to establish a second work area, step (b) is repeated, step (c) is repeated with one marginal edge of the screen applied to the second work area extending into at least abutting relation to the proximal edge of the screen applied to the first work area, and step (d) is repeated.

3. A method according to claim 1 wherein a moisture barrier is applied to the surface of solid plaster and allowed to dry before applying joint compound.

4. A method according to claim 1 wherein a binder is applied to the surface of solid plaster and allowed to dry before applying joint compound.

5. A method according to claim 4 wherein the binder serves as a moisture barrier when dried.

6. A method according to claim 1 wherein the screen has a thickness of about twelve mils.

7. A method according to claim 6 wherein said screen has at least ten warp and filling yarns per square inch

8. A method according to claim 6 wherein the screen has between fifteen and twenty warp and filling yarns per square inch.

9. A method according to claim 1 wherein plaster of paris is applied to the surface of solid plaster and allowed to dry before applying joint compound.

10. A method according to claim 1 wherein a work area on said surface of solid plaster as defined in Step (a) includes at least one relatively wide and shallow depression, wherein Step (c) includes arranging the screen to follow the contour of the depression and pressing the screen against the solid plaster surface of the said relatively wide and shallow depression, wherein Step (d) is modified by omitting Step (d) (1) in the area of said wide and shallow depression, and Steps (d) (2), (d) (3) and (d) (4) are modified to the extent that enough joint compound remains in the wide and shallow depression to extend through the screen and fill the depression.

* * * * *